US007278401B1

(12) United States Patent
Cotton et al.

(10) Patent No.: US 7,278,401 B1
(45) Date of Patent: Oct. 9, 2007

(54) FUEL PRESSURE REGULATOR HOUSING

(75) Inventors: Kenneth J. Cotton, Caro, MI (US); Jeffrey D. Hanby, Cass City, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 280 days.

(21) Appl. No.: 11/082,395

(22) Filed: Mar. 17, 2005

Related U.S. Application Data

(60) Provisional application No. 60/623,560, filed on Oct. 29, 2004.

(51) Int. Cl.
*F02M 69/54* (2006.01)
*F02M 69/50* (2006.01)

(52) U.S. Cl. ..... 123/457; 123/515

(58) Field of Classification Search ..... 123/457, 123/458–466, 468–470, 514, 515
See application file for complete search history.

(56) References Cited

U.S. PATENT DOCUMENTS 5,092,300 A * 3/1992 Imoehl et al. ..... 123/469
5,094,211 A * 3/1992 Mahnke et al. ..... 123/463
5,425,342 A * 6/1995 Ariga et al. ..... 123/456
5,479,900 A * 1/1996 Bodenhausen et al. ..... 123/470
5,577,478 A 11/1996 Tuckey
5,720,263 A * 2/1998 Frank et al. ..... 123/514
5,967,119 A * 10/1999 Burkhard et al. ..... 123/458
6,216,671 B1 4/2001 Sawert et al.
6,283,772 B1 9/2001 Braun et al.
6,298,828 B1 * 10/2001 Concialdi ..... 123/457
6,343,589 B1 * 2/2002 Talaski et al. ..... 123/514
6,619,314 B2 * 9/2003 Wynn et al. ..... 137/454.6
6,966,307 B2 * 11/2005 Shin ..... 123/514

* cited by examiner

*Primary Examiner*—Mahmoud Gimie
(74) *Attorney, Agent, or Firm*—Reising, Ethington, Barnes, Kisselle, P.C.

(57) ABSTRACT

A housing for a fuel pressure regulator includes a body having a fuel inlet, a fuel outlet, a plurality of retention members, a bypass fitting, and preferably an electrical fitting and a ground fitting. Each retention member includes a catch that is constructed to engage and securely hold the fuel pressure regulator in the housing, while the fuel inlet, the fuel outlet and the bypass passage permit fuel routing as pressurized fuel passes through the fuel pressure regulator. The regulator housing preferably is made of an electrostatic charge dissipative material and is formed in one piece using a single manufacturing process such as injection molding.

23 Claims, 7 Drawing Sheets

112
25
110
108
92
14
22
60
16
26
72
64
60'
99
22'
76
82
90
102
104
80
83
84
44

14
65
64
72
66
69
16
46
71
22
22'
62
76
82
84
90
60
26
25
80
100
99
102
104
92

22
14
72
64
60
56
46
24
66
86
84
20
76
80
82
18
90
60'
25
83
108
110
92
44
26
112

FUEL PRESSURE REGULATOR HOUSING

REFERENCE TO RELATED APPLICATION

Applicants claim the benefit of U.S. Provisional Patent Application Ser. No. 60/623,560, filed Oct. 29, 2004.

FIELD OF THE INVENTION

The present invention relates to fuel systems and, more particularly, to a fuel system including a fuel pressure regulator.

BACKGROUND OF THE INVENTION

In many engines with fuel injection systems, it is desirable to supply liquid fuel to the fuel injector or injectors from a fuel pump that continuously delivers a flow rate of liquid fuel sufficient to supply the maximum fuel demand of the engine. Therefore, under engine operating conditions, wherein the engine has a lesser fuel demand, there is an excess of fuel being supplied from the fuel pump. This is especially true when the engine is idling and has an extremely low fuel demand.

In such systems, a bypass regulator is utilized to provide a bypass fuel flow path downstream of the fuel pump through which excess fuel delivered from the fuel pump is returned to the fuel tank. The fuel pressure regulator may be located within the fuel tank immediately downstream of the fuel pump to bypass excess fuel delivered from the fuel pump directly into the fuel tank. In some applications, the fuel pressure regulator may be located downstream of an engine fuel rail or injectors to bypass excess fuel to the fuel tank through a fuel return line. In this way, the pump can be continuously operated to maintain a high rate of fuel output so as to be able to accommodate a rapidly increasing demand for fuel by the engine.

SUMMARY OF THE INVENTION

A housing for a fuel pressure regulator includes a body having at least one inlet passage, at least one outlet passage and at least one bypass passage. The inlet, outlet and bypass passages fluidly communicate to control fluid flow through the housing. At least one retainer is formed in the body and includes a head having a retention surface that engages the regulator and secures the regulator within the housing. The housing preferably is made from an electrostatic dissipative material in a single manufacturing process.

Also in accordance with one presently preferred implementation of the invention, a fuel pump module receives a fuel pump that fluidly communicates with a fuel pressure regulator. The pressure regulator is disposed within a housing that includes a body having at least one inlet passage, at least one outlet passage and at least one bypass passage. The inlet, outlet and bypass passages fluidly communicate to thereby control fluid that flows through the housing member. At least one retention member is formed with the body and includes a head having a retention surface that, in assembly, engages the regulator. The housing preferably is made from an electrostatic dissipative material in a single manufacturing process.

Objects, features and advantages of this invention include providing a housing that securely holds a fuel pressure regulator, permits control and routing of fuel bypassed by the regulator, allows bypassed fuel to be returned to the fuel tank, fuel pump or fuel reservoir to permit recycling of the bypassed fuel, dissipates static electricity, may be formed from an electrostatic dissipative material, may be molded in a single step process, can be readily adapted to any fuel pump module, is relatively inexpensive to manufacture, easy to assemble, has a robust design so that the housing can withstand relatively high levels of fuel pressure, and has a long useful in-service life.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
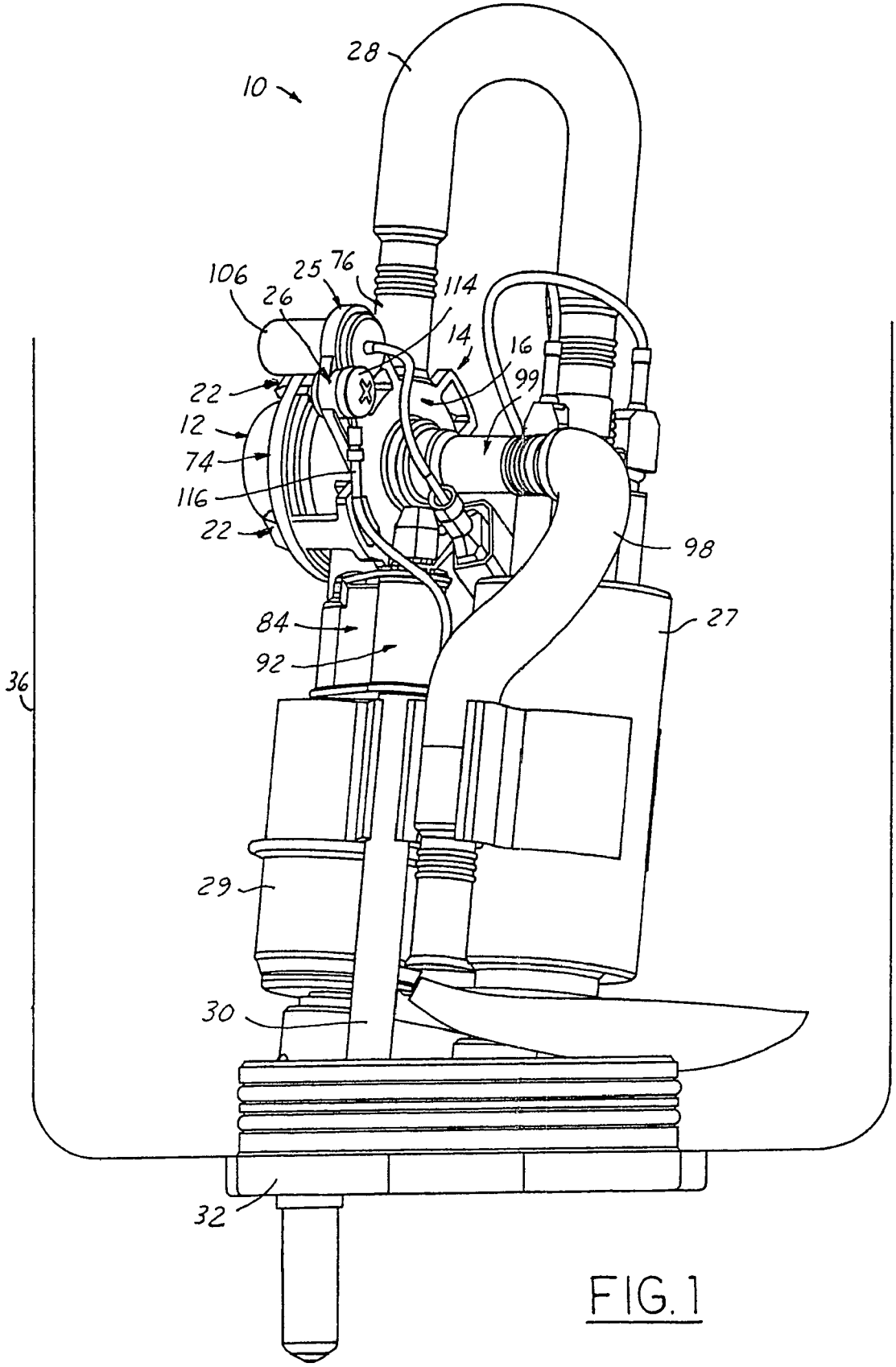
FIG. 1 is a perspective view of a fuel pump module including a fuel pressure regulator supported on the fuel pump module by a regulator housing constructed according to one presently preferred embodiment of the invention.
Figure 2:
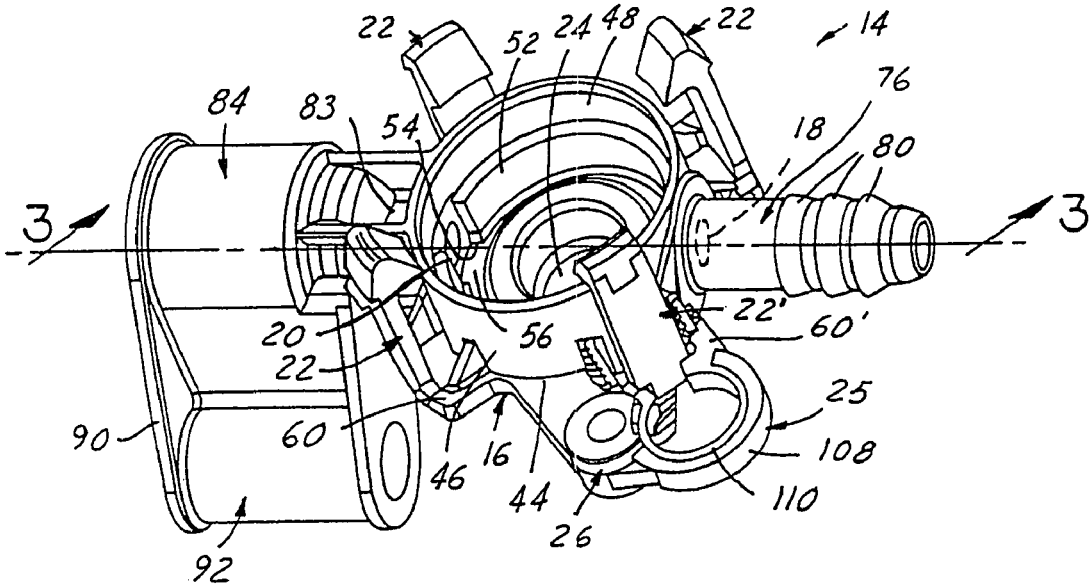
FIG. 2 is a perspective view of the regulator housing of FIG. 1.

Referring in more detail to the drawings, FIG. 1 illustrates a fuel pump module 10 for use in a fuel injection system for a combustion engine (not shown) that includes a fuel pressure regulator 12 received in and supported by a regulator housing 14. With reference to FIGS. 1 and 2, the regulator housing 14 preferably is injection molded in one piece of a plastic material which dissipates static electricity. The housing has a body 16 with a fuel inlet passage 18, a fuel outlet passage 20, a plurality of retention members 22 (two of which are shown in FIG. 1), a bypass passage 24, an electrical fitting 25 and a ground fitting 26. The retention members 22 are constructed to engage and securely hold the fuel pressure regulator 12 within the housing 14, while the fuel inlet 18, the fuel outlet 20 and the bypass passage 24 route pressurized fuel into and out of the fuel pressure regulator 12. The regulator housing 14 may suitably be used for securing a fuel pressure regulator in any fuel pump module or other location and may be adapted for varying fuel pressures and is usable in motorcycles, automobiles or other vehicles, by way of examples without limitation.

As shown in FIG. 1, the fuel pump module 10 is composed of several component parts carried by one or more rods or tubes 30 that connect with a flange mount 32. Carried by the flange mount 32 is an electric fuel pump 27, a fuel pressure regulator 12 downstream of the fuel pump 27, and a fuel filter 29 preferably arranged downstream of the fuel pressure regulator 12 to filter fuel that is then delivered to the engine. The regulator 12 could be arranged in a fuel return line and inside or outside of the fuel tank if a so-called return-type fuel system is used. The flange mount 32 preferably carries one or more electrical connectors and/or sensors and one or more fuel conduits or nipples (all not shown) that connect with a fuel line leading to the engine. The module components are disposed inside a fuel tank 36 by connecting and sealing the flange mount 32 to the fuel tank wall.

The fuel pump 27 preferably includes an electrically driven motor and is designed to take in fuel through an inlet and discharge fuel under pressure through an outlet for delivery to the engine. The pressure and flow rate of fuel discharged from the fuel pump preferably is suitable to support engine operation at high load or maximum fuel demand engine operating conditions. The fuel pump may be constructed generally as disclosed in U.S. Pat. No. 6,547,515, the disclosure of which is incorporated by reference in its entirety.

Figure 3:
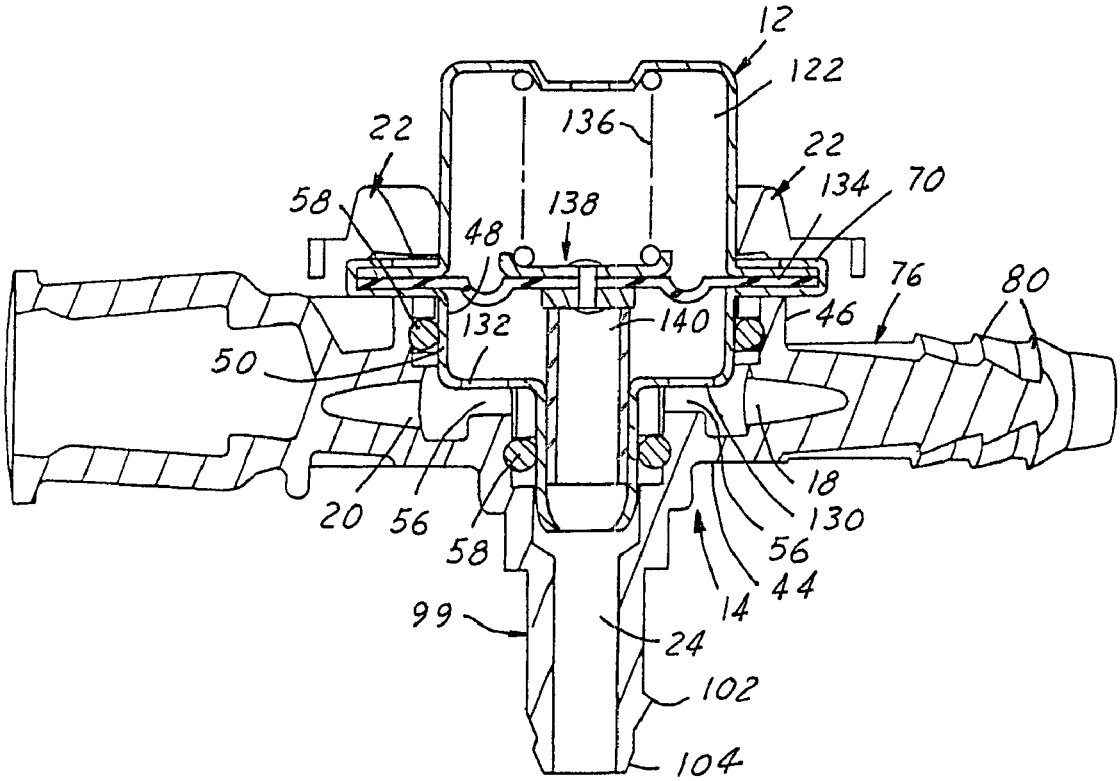
FIG. 3 is a cross sectional view of the regulator housing taken along line 3-3 of FIG. 2 and including the fuel pressure regulator mounted therein also shown in section.

With reference to FIG. 3, pressurized fuel discharged from the fuel pump outlet flows into the inlet fitting 76 to the inlet passage 18 and enters the regulator 12 through its inlets 130, 132. The fuel pressure regulator 12 controls the pressure of the fuel that passes through its outlet for subsequent delivery to the engine. The pressure regulator 12 includes bypass inlets 130, 132, a diaphragm 134, a spring 136, a valve 138 and a bypass passage 140. When the pressure of the fuel entering the inlet passage 18 is above a threshold value, the regulator 12 bypasses fuel back to the fuel tank 36 for future use and sends fuel to the engine at a pressure and flow rate suitable for instantaneous engine operation. The fuel acts on the diaphragm 134 against the force of the spring 136 to control opening and closing of the valve 138 for bypassing fuel through the bypass passage 140. Fuel also passes out of the outlet passage 20 and is supplied to the engine at a pressure and flow rate suitable for instantaneous engine operation. Bypassed fuel is routed back to the fuel tank through the bypass passage 24 for future use. The regulator components are disposed between an upper housing 122 and a lower housing 50 that are joined at a radially outwardly extending flange 70.

With reference now to FIGS. 2-3, the body 16 of the housing 14 includes a base 44, a cylindrical wall 46, and a pocket 48 defined between them. The pocket 48 is constructed to receive the lower housing 50 of the pressure regulator 12 and several steps are formed in the pocket 48 that are complementary to the contours of the lower housing 50. The inlet passage 18 and the outlet passage 20 are formed into a step 52 and open into the pocket 48 so that the inlet 18 and outlet 20 communicate with each other through a portion of the pocket 48. As better shown in FIG. 2, a bottom surface 54 of the step 52 and the base 44 of the body 16 define a fluid chamber 56 that allows the passage of fuel into and out of the regulator housing 14 by way of the inlet 18 and outlet 20. As shown in FIG. 3, the fluid chamber 56 is sealed by disposing elastomeric seals such as O-rings 58 above and below the fluid chamber 56 between the lower housing 50 of the regulator 12 and the regulator housing 14.

With reference now to FIGS. 2 and 4-7, the base 44 includes tabs 60 that project generally radially outwardly from the cylindrical wall 46 and generally parallel to the base 44. A retention member 22 that projects axially beyond the pocket 48 is formed extending generally from each tab 60. Each retention member has a body 62 supporting a head 64. The head 64 includes a catch 66 facing radially inwardly toward the center of the pocket 48 and has a radially inwardly sloped ramp 69 and a radially extending shoulder 71. A barb or second catch 72 is formed on the opposite side of the head 64 from the shoulder 71 and extends radially outwardly from the pocket 48. Each head 64 preferably also includes a radially outwardly sloped ramp 65 extending from its tip toward the second catch 72. As shown in the figures, one tab 60' and its associated retention members 22' is different from the other tabs 60 and retention members 22 to facilitate molding the housing 14 with the electrical fitting 25 and the ground fitting 26 on or integral with the tab 60'.

Figure 4:
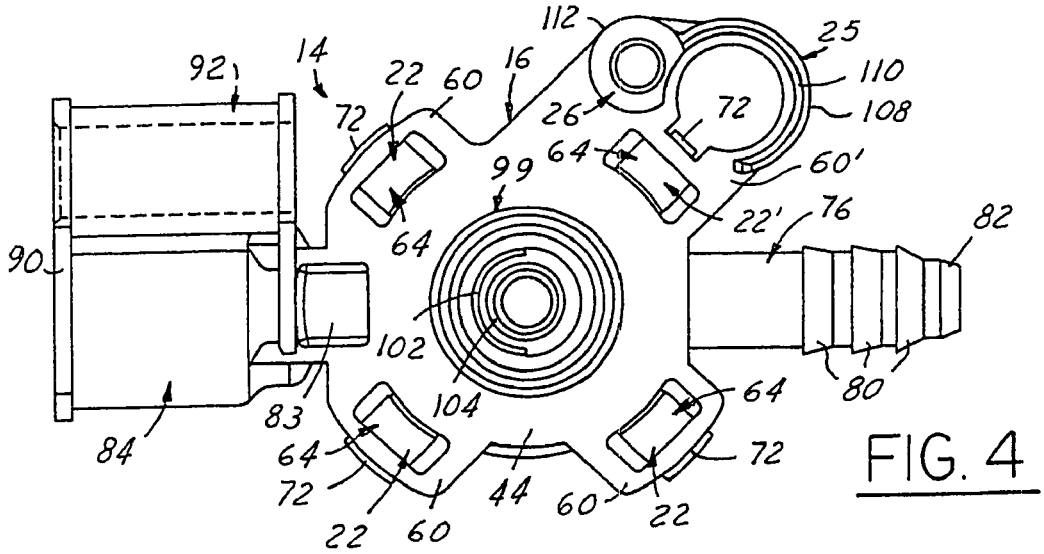
FIG. 4 is a bottom view of the regulator housing of FIG. 2.
Figure 5:
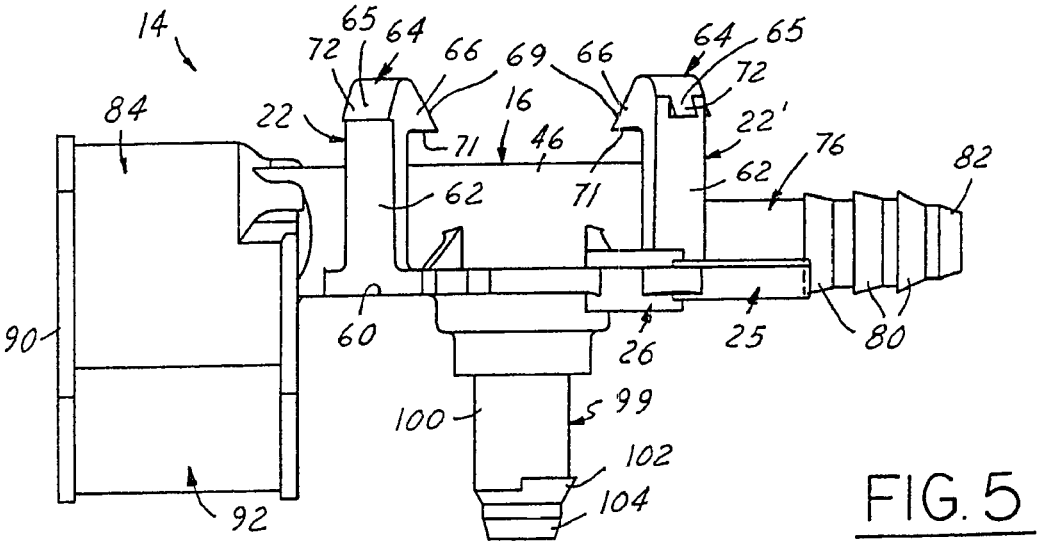
FIG. 5 is a front view of the regulator housing of FIG. 2.
Figure 6:
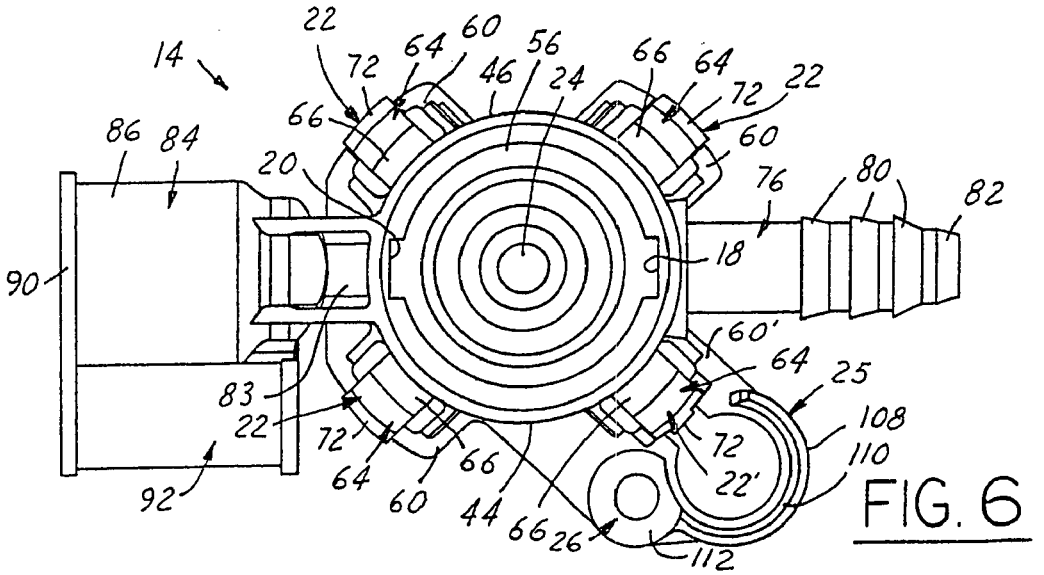
FIG. 6 is a top view of the regulator housing of FIG. 2.

As shown in FIGS. 2, 4 and 6, the retention members 22, 22' are situated about the periphery of the base 44 on the tabs 60, 60', respectively at a circumferential spacing for suitably retaining the regulator 12 within the housing 14. The location and arrangement of the retention members 22, 22' can be chosen, at least in part, based on the strength of the members 22, 22', the materials used and the design thereof. The regulator housing 14 may also be provided with more or less than four retention members depending, for example, upon the anticipated pressure of the fuel that will flow through the regulator and the housing, where higher pressures may require more or stronger retention members to suitably retain the regulator in the housing.

With reference now to FIG. 6, the fuel inlet passage 18 of the regulator housing 14 is defined within an inlet fitting 76 that is integrally formed with the cylindrical wall 46 of the housing 14 adjacent the base 44. The inlet fitting 76 preferably includes at least one, or more preferably, three barbs 80 formed thereon and adjacent a tip 82, so that the inlet fitting 76 can frictionally retain a fuel line 28, as shown in FIG. 1. Although a single barb could adequately hold the fuel line 28, the triple barb design advantageously facilitates the disposal and attachment of the fuel line 28 on the inlet fitting 76 and requires no additional parts or clamps to ensure the fluid tight connection of the two components. The three barbs 80 can easily be molded with the fitting 76 which reduces manufacturing and assembly costs.

Figure 7:
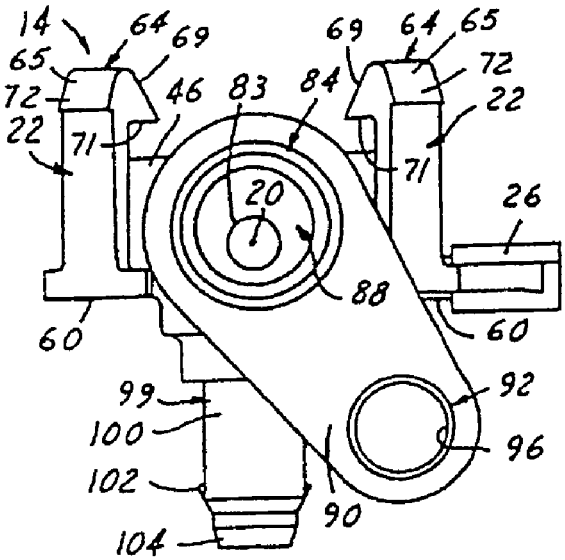
FIG. 7 is an end view of the regulator housing of FIG. 2.

As also shown in FIG. 6, the fuel outlet 20 of the regulator housing 14 is defined by an outlet fitting 83 that is also integrally formed with the cylindrical wall 46 of the housing 14 adjacent the base 44. As better shown in FIG. 7, the outlet fitting 83 is attached to a first receptacle 84 that defines a passageway 88 where the first receptacle 84 is constructed to mate with an outlet fitting of the fuel filter 29. The first receptacle 84 shares a common base 90 with a second receptacle 92 formed adjacent thereto and designed to receive the support rod 30. With reference to FIGS. 6 and 7, the body 86 of the first receptacle extends to the base 90. Seals, such as o-rings, may be disposed within the passageway 88 to thereby seal the fuel outlet 20 of the housing 14 with the fitting of the fuel filter 29.

As shown in FIGS. 2-7, the bypass passage 24 is formed in the body 44 and is defined at least in part by a bypass fitting 99, which is integrally formed into the base 44 of regulator housing 14. The bypass fitting 99 is constructed to mate with a bypass hose 98 (shown in FIG. 1) or other tubular structure to thereby route fuel bypassed by the pressure regulator 12 back into the fuel tank 36. The bypass fitting 99 is constructed similarly to that of the fuel inlet fitting 76 except that the bypass fitting 99 includes a body 100 having a partial barb 102 that extends only partially circumferentially around the body 100 adjacent a tip 104. The partial barb 102 allows for a more simplified molding process so that the second receptacle 92 can be simultaneously formed in the single molding process, thereby lowering manufacturing costs. Also, the partial barb 102 is particularly useful for preventing the bypass hose 98 from twisting when mated with the bypass fitting 99 of the housing 14 to maintain a desired orientation of the hose 98 for properly delivering the bypass fuel back to the fuel tank 36. Of course, the bypass fitting may have any number of full or partial barbs or a combination thereof. Furthermore, the fitting 99 and hose 98 allow bypass fuel to be routed and directed to a desired location rather than just spraying or dumping the bypass fuel in the fuel tank, which minimizes noise as well as fuel foaming, fuel turbulence, and fuel vapor formation. The bypass fuel hose 98 can be directed, for example, at a pump inlet filter to improve the fuel supply to the fuel pump.

As shown in FIGS. 2, 4 and 6, the electrical fitting 25 is integrally formed with the base 44 of the housing 14 on the tab 60' and is constructed to receive an electrical sensor or switch 106 (shown in FIG. 1) or another electrical device that can monitor, for example, the level of fuel within the fuel tank and may be used to provide an indication or signal at low fuel levels in the fuel tank. The electrical fitting 25 comprises a cylindrical wall 108 including a step 110 formed on each side of the interior portion of the wall 108. The step 110 permits the sensor 106 to be mounted on either side of the electrical fitting 25 for desired orientation and location of the sensor 106.

The ground fitting 26 is formed adjacent to the electrical fitting 25 on the same tab 60' integrally formed with the base 44 of the body 16. The ground fitting 26 also comprises a cylindrical wall 112 that is constructed to receive a fastener such as a nut and bolt, screw, rivet, self-tapping screw or other suitable fastener 114 to retain a ground contact and attached wire 116 that is grounded (shown in FIG. 1). The ground wire 116 operates to ground the sensor 106. The head of the bolt 114 preferably overlies a portion of the sensor 106 and retains it in the electrical fitting 25 in assembly.

Figure 8:
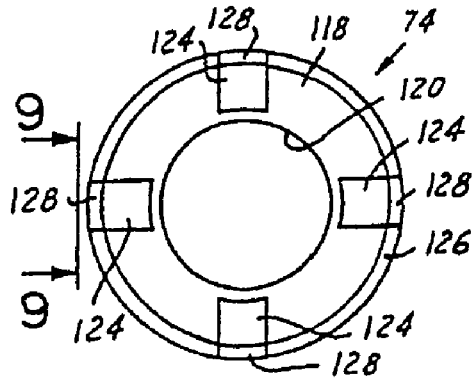
FIG. 8 is a top view of a presently preferred embodiment of a retaining ring used with the housing of FIG. 2 when the regulator is mounted therein.
Figure 9:
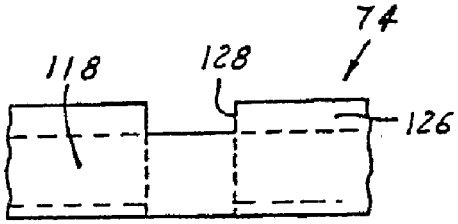
FIG. 9 is a fragmentary side view of the retaining ring of FIG. 8.
Figure 10:
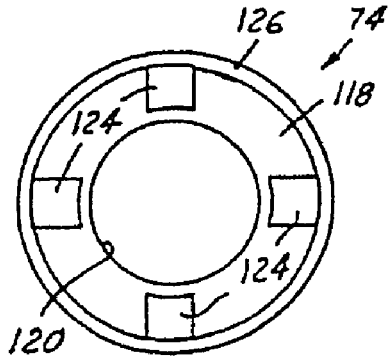
FIG. 10 is a bottom view of the retaining ring of FIG. 8.

A retaining ring 74 is used to securely hold the retention members 22, 22' about the flange 70 of the regulator 12 in assembly. The retaining ring 74 is particularly useful when high pressure fuel flows through the regulator tending to force the regulator upwards against the retention members 22, 22' which tends to separate the retention members 22, 22'. A first embodiment of a retaining ring is shown in FIGS. 8-10. As shown in FIG. 8, the retaining ring 74 is annular and has a flat portion 118 with a hole 120 that is sized to receive the upper housing 122 of the pressure regulator 12 (shown in FIG. 3). For each retention member 22, 22', the retaining ring 74 has a hole 124 through which the head 64 of each retention member 22, 22' extends. The retaining ring 74 further includes an axially and circumferentially extending wall 126 that surrounds the flat portion 118 and includes one or more recesses 128 formed therein, where each recess 128 corresponds and is aligned with a hole 124 formed in the flat portion 118 of the retaining ring 74. As shown in FIG. 10, the axial face of the wall 126 opposite the recesses 128 is preferably circumferentially continuous.

Figure 12:
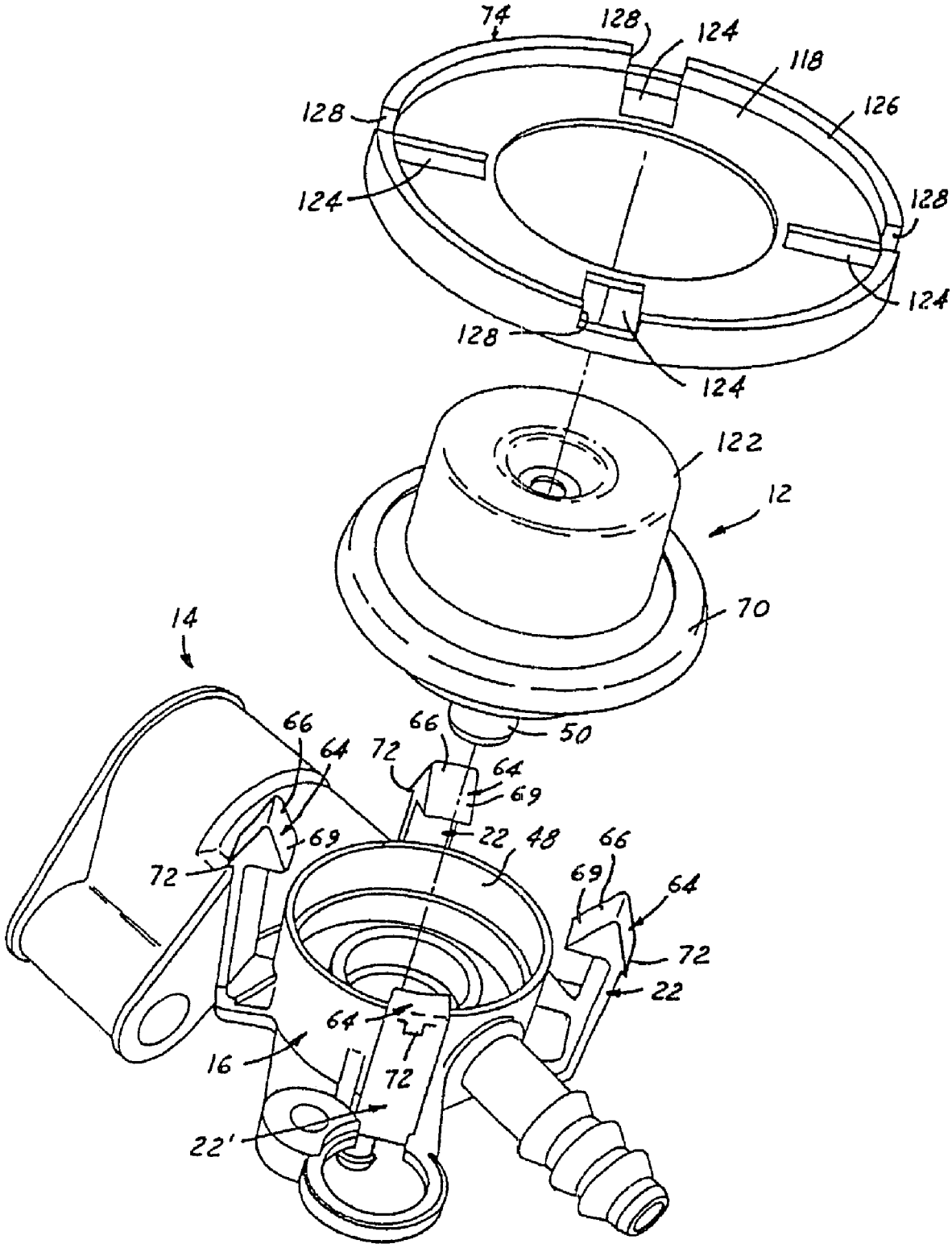
FIG. 12 is an exploded view of the pressure regulator housing and retaining ring.

In reference now to FIG. 12, the lower portion 50 of the pressure regulator 12 is pushed into the pocket 48 of the housing 14 so that the flange 70 engages the ramps 69 and outwardly flexes the retention members 22, 22' until the flange 70 passes the ramps 69 and the retention members 22, 22' return to their unflexed orientation wherein the catch 66 of each member 22, 22' overlies the flange 70. Then the retaining ring 74 is positioned so that the heads 64 are received in the retaining ring holes 124 and advanced until the second catches 72 are received through the holes 124. The axial position of the retaining ring 74 is maintained by engagement of each of the second catches 72 with the ring 74 in the area of the recesses 128. The retaining ring 74 prevents radially outward deflection of the retention members 22, 22' to maintain the catches over the flange 70 of the regulator 12. The inner diameter between the retention members 22, 22' when not flexed preferably is less than the outer diameter of the flange 70.

Figure 11:
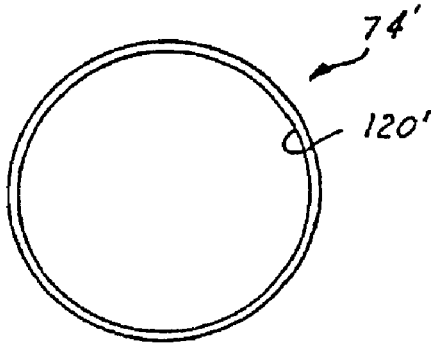
FIG. 11 is top view of a second exemplary embodiment of a retaining ring.

A modified retaining ring 74' may also be provided as a more simple annulus as shown in FIG. 11. The ring 74' includes a hole 120' with an inner diameter large enough to receive each of the retention members 22, 22' and engage the second catches 72. The retaining ring 74' also prevents radially outward deflection of the retention members 22, 22' to ensure retention of the fuel pressure regulator in assembly. The assembly of the retaining ring 74' is generally the same as that described for retaining ring 74 shown in FIG. 12.

After the regulator 12 has been mounted within the housing 14, fuel is free to flow through the inlet 18 of the housing 14 and into the inlets 130, 132 of the regulator 12. With reference again to FIG. 3, fuel flows into the housing 14 through inlet fitting 76, through the inlet passage 18, and into the bypass inlets 130, 132 of the regulator 12. If the fuel pressure exceeds a threshold value, the fuel will cause the diaphragm 134 to flex against the spring 136 to open the valve 138 and permit fuel flow out the bypass 140, through the bypass passage 24 (which is defined at least in part by the fitting 99) and into the bypass hose 98 for discharge in the fuel tank 36. The remaining fuel in the regulator 12 will pass through the outlet 20 of the housing 14 and into the fuel filter 29 for subsequent delivery to the engine.

The lower and upper portions 50, 122 of the regulator 12 are generally made of an electrically conductive material. As such, when fuel flows through the regulator 12 at a relatively high velocity, electrostatic charging of the electrically conductive components may occur. In some cases, it may be desirable to carry the electrically conductive regulator 12 in a plastic housing. In this embodiment, the housing 14 preferably is made of a static charge dissipative plastic material generally of a carbon containing or impregnated powder material that dissipates any static electric charge generated in the pressure regulator 12. The housing 14 is formed using an injection molding or any other suitable molding process.

Figure 13:
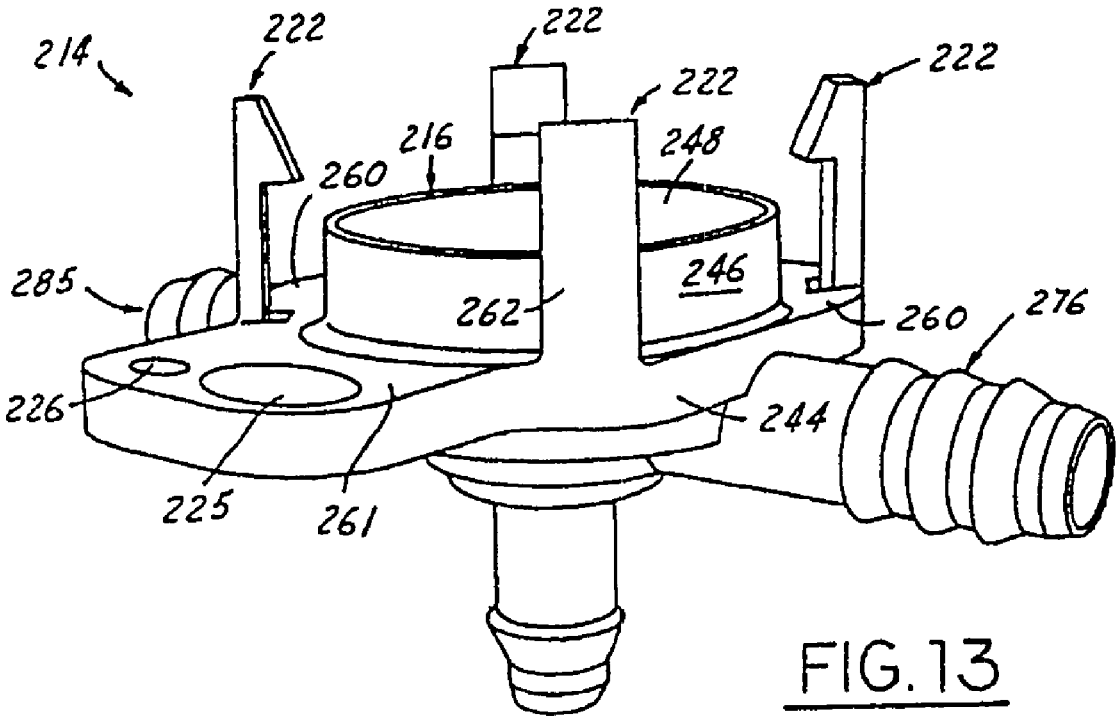
FIG. 13 is a perspective view of a second exemplary embodiment of a regulator housing for retaining a fuel pressure regulator.
Figure 14:
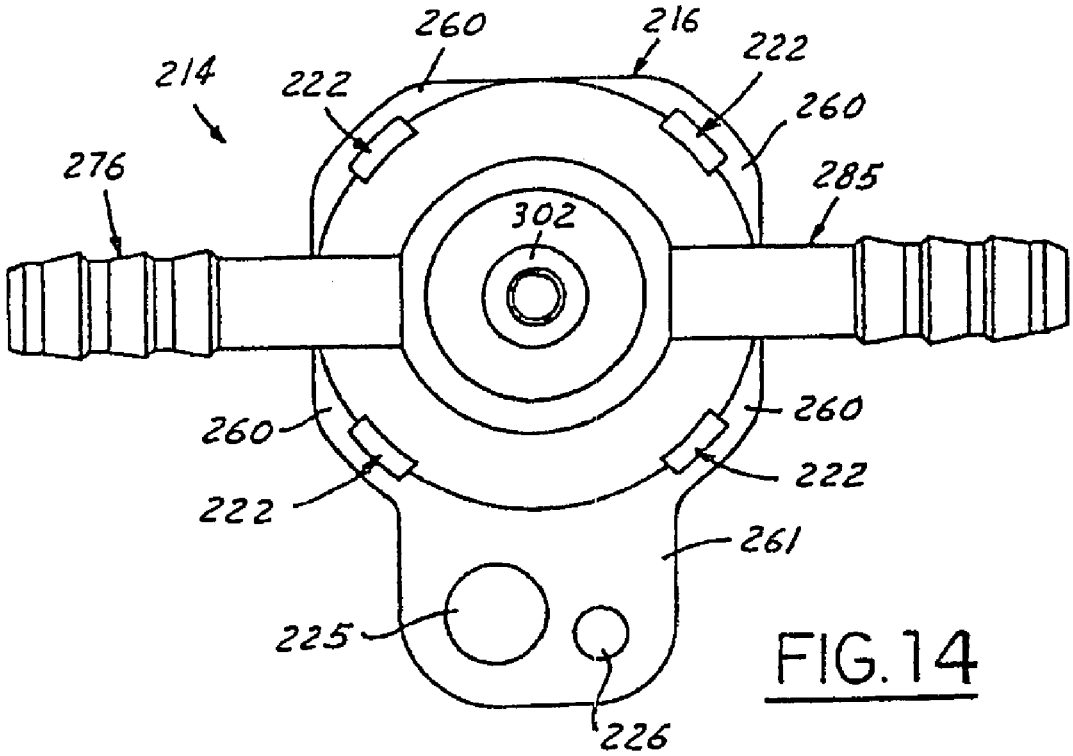
FIG. 14 is a bottom view of the regulator housing of FIG. 13.
Figure 15:
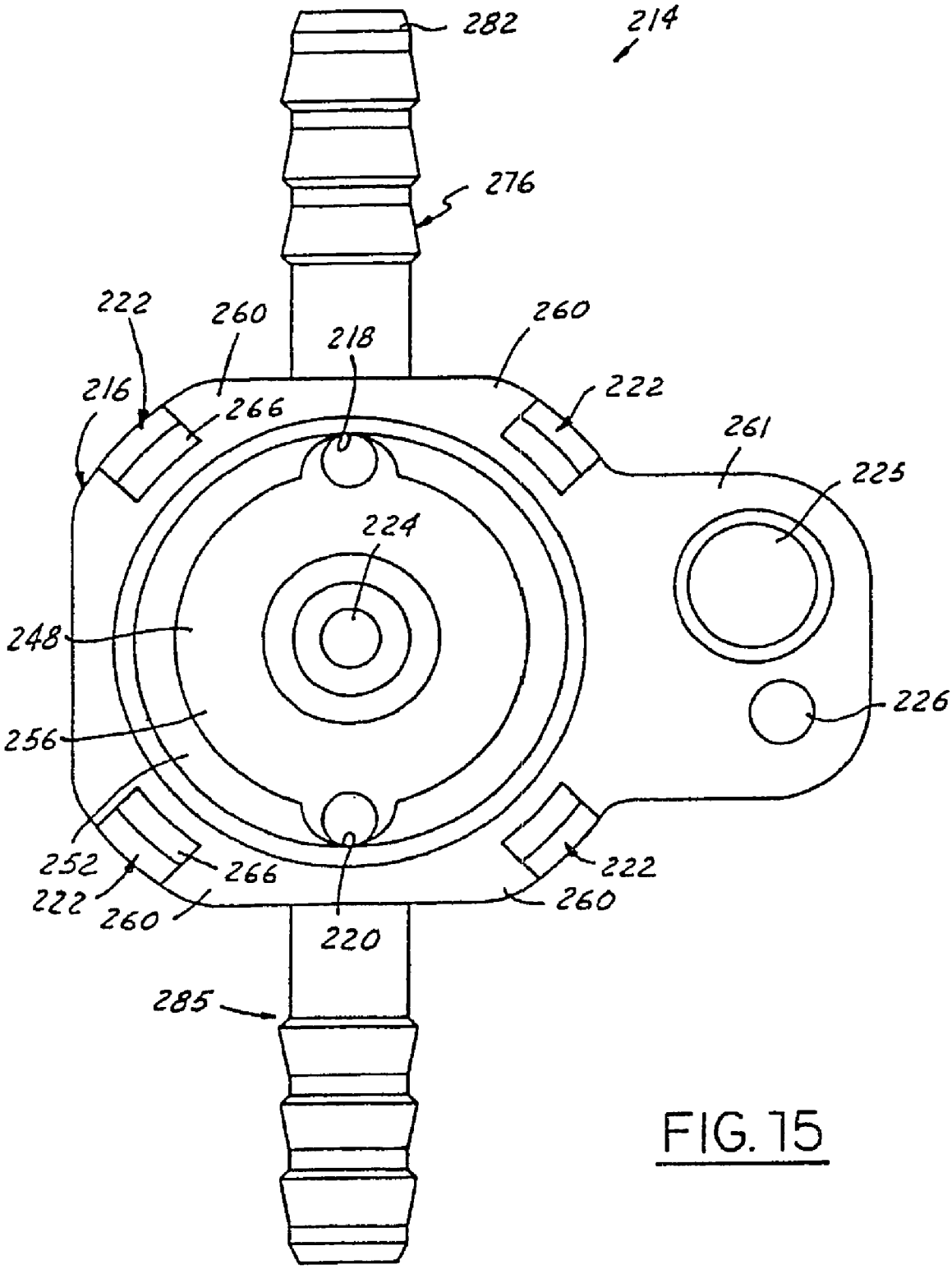
FIG. 15 is a top view of the regulator housing of FIG. 13.

A second embodiment of a regulator housing 214 is shown in FIGS. 13-15, which is substantially similar to the design of the first embodiment, where like reference numbers denote like parts. Like the housing 14 of the first embodiment, the regulator housing 214 includes a body 216 having a base 244 abutting one end of a cylindrical wall 246, thereby defining a pocket 248. A number of steps are formed in the pocket 248 and they generally conform to the contour of a pressure regulator to be housed therein. As shown in FIG. 15, an inlet passage 218 and an outlet passage 220 open into the pocket 248, and a bottom surface of a step 252 and the base 244 of the body 216 define a fluid chamber 256 that allows the passage of fuel into and out of the regulator housing 214.

As shown in FIGS. 13-15, the base 244 includes four tabs 260 that are disposed outside the wall 246, and are each constructed to support a retention member 222. The base 244 further includes a flange 261 with an electrical fitting 225 and a ground fitting 226 integrally formed therewith. The electrical fitting 225 and the ground fitting 226 are preferably holes formed into the flange 261, and are constructed to receive a switch and a ground wire both preferably held in place by a retainer such as a nut and bolt, screw, rivet, clip, self-tapping screw, or other suitable fastener.

Each retention member 222 projects generally perpendicularly from its tab 260 and beyond the pocket 248. Each retention member 222 has substantially the same construction as the retention members 22 of the first embodiment except that the retention members 222 do not include a barb or catch 72 formed on the head that extends radially outwardly away from the pocket 248.

The fuel inlet passage 218 of the housing 214 is defined within a fitting 276 that is integrally formed with the cylindrical wall 246 of the housing 214 adjacent the base 244, which is substantially similar to that of the first embodiment. The outlet passage 220, however, is defined within a fitting 285, which has substantially the same construction as the inlet fitting 276. The inlet and outlet fittings 276, 285 permit easy attachment of fuel hoses or other components.

The regulator housing 14, 214 provides a secure attachment of the fuel pressure regulator in a fuel pump module. The molded part, which is easy to manufacture, is preferably made of a static electric charge dissipative material, thereby reducing the electrostatic charge often generated in the pressure regulator. The molded regulator housing also permits routing of bypassed fuel as desired through a bypass fitting on the housing and through an adjoining conduit.

While the forms of the invention herein disclosed constitute presently preferred embodiments, many others are possible. It is not intended herein to mention all the possible equivalent forms or ramifications of the invention. It is understood that terms used herein are merely descriptive, rather than limiting, and that various changes may be made without departing from the spirit and scope of the invention as defined by the following claims.

The invention claimed is:

1. A housing for holding a regulator that has a housing in which a valve is carried, comprising:
- a body adapted to receive a portion of the regulator housing;
- at least one inlet passage formed with said body;
- at least one outlet passage and at least one bypass passage each formed with said body and in fluid communication with said at least one inlet passage; and
- at least one retention member formed with said body and constructed to engage said regulator housing to retain the position of the regulator relative to the body.

2. The housing of claim 1 wherein said body comprises a base and a wall at least partially defining a pocket, wherein said pocket is constructed to receive at least a portion of said regulator.

3. The housing of claim 2 wherein said at least one retention member is carried by said base of said body and projects substantially away from said base and beyond said pocket.

4. The housing of claim 2 wherein said at least one retention member comprises a head having at least one catch formed thereon, the catch being adapted to overlie a portion of the regulator housing.

5. The housing of claim 2 which also comprises a retaining ring that cooperates with said retention member to retain the position of a pressure regulator relative to the body and wherein said at least one retention member comprises a first catch constructed to engage said regulator and a second catch formed on an opposite side of said retention member from said first catch and constructed to engage said retaining ring.

6. The housing of claim 5 wherein said retaining ring comprises at least one recess constructed to receive said second catch of said retention member.

7. The housing of claim 1 wherein said body is composed of an electrostatic charge dissipative material.

8. The housing of claim 1 wherein said at least one bypass passage communicates with a fitting having at least one barb.

9. The housing of claim 8 wherein said barb extends only partially around the circumference of the fitting.

10. The housing of claim 1 further comprising an electrical fitting carried by said body.

11. The housing of claim 1 further comprising a ground fitting carried by said body.

12. The housing of claim 3 wherein a plurality of retention members are disposed around a periphery of said pocket with each retaining member including a catch extending inwardly toward the pocket and adapted to overlie a portion of the regulator.

13. A fuel pump modules comprising:
- a fuel pump having an inlet and an outlet;
- a fuel pressure regulator that fluidly communicates with said outlet and includes a housing; and
- a body separate from the housing of the regulator and constructed to retain said fuel pressure regulator, wherein said housing comprises:
- at least one inlet passage formed with said body;
- at least one outlet passage and at least one bypass passage each formed with said body and in fluid communication with said at least one inlet passage; and
- at least one retention member formed with said body and constructed to engage said regulator housing.

14. The fuel pump module of claim 13 wherein said body comprises a base and a wall at least partially defining a pocket, wherein said pocket is constructed to receive at least a portion of said regulator.

15. The fuel pump module of claim 14 wherein said at least one retention member is formed in said base of said body and projects substantially away from said base and beyond said pocket.

16. The fuel pump module of claim 14 wherein said at least one retention member comprises a head having at least one catch formed thereon, with said catch extending toward the pocket.

17. The fuel pump module of claim 14 wherein said at least one retention member comprises a first catch constructed to engage said regulator.

18. The fuel pump module of claim 13 which also includes a retaining ring and said at least one retention member comprises a second catch constructed to engage the retaining ring.

19. The fuel pump module of claim 18 wherein said retaining ring comprises at least one recess constructed to receive said second catch of said retention member.

20. The fuel pump module of claim 13 wherein said body is composed of an electrostatic dissipative material.

21. A housing that retains a regulator which has a housing that carries a valve, comprising:
- a body defining a pocket in which a portion of the regulator is received;
- at least one inlet passage formed with said body;
- at least one outlet passage and at least one bypass passage each formed with said body and in fluid communication with said at least one inlet passage; and a plurality of retention members formed with said body, each retention member having a catch facing inwardly toward the pocket and adapted to overlie and engage the regulator housing to retain the position of the regulator relative to the body.

22. The housing of claim 21 which also comprises a retaining ring adapted to be received around a portion of the regulator housing and around each retention member, and wherein the retention members include a second catch facing outwardly away from the pocket and adapted to overlie the retaining ring to maintain the retaining ring on the retention members.

23. The housing of claim 22 wherein the retaining ring is circumferentially continuous and includes a plurality of holes, with each retention member extending through a separate one of the holes.

* * * * *

UNITED STATES PATENT AND TRADEMARK OFFICE

CERTIFICATE OF CORRECTION

PATENT NO. : 7,278,401 B1
APPLICATION NO. : 11/082395
DATED : October 9, 2007
INVENTOR(S) : Kenneth J. Cotton et al.

It is certified that error appears in the above-identified patent and that said Letters Patent is hereby corrected as shown below:

Column 8
Line 23, delete “modules” and insert --module,--.

Signed and Sealed this

First Day of January, 2008

JON W. DUDAS
*Director of the United States Patent and Trademark Office*